United States Patent [19]

Yu et al.

[11] Patent Number: 4,731,717

[45] Date of Patent: Mar. 15, 1988

[54] SUPPORT STRUCTURE FOR PLATE GLASS LAMP SHADES

[75] Inventors: Kang Yu; Jiann Yu, both of 2nd Fl., No. 24, Lane 295, Sec. 1, Fu Hsing S. Road, Taipei, Taiwan

[73] Assignees: Kang Yu; Jiann Yu; Judith Chyou, all of Taiwan, Taiwan

[21] Appl. No.: 31,362

[22] Filed: Mar. 30, 1987

[51] Int. Cl.[4] ..... F21V 11/00

[52] U.S. Cl. ..... 362/352; 362/360; 362/358

[58] Field of Search ..... 362/351, 352, 358, 360, 362/361

[56] References Cited

U.S. PATENT DOCUMENTS

| | | | |
|---|---|---|---|
| 912,426 | 2/1909 | Sibley | 362/360 |
| 980,306 | 1/1911 | Lumley | 362/360 |
| 1,123,792 | 1/1915 | Person et al. | 362/360 |
| 3,689,762 | 9/1972 | Shatan | 362/352 |
| 3,757,110 | 9/1973 | Soboleski | 362/360 |
| 4,165,529 | 8/1979 | Hagelthorn | 362/352 |
| 4,277,822 | 7/1981 | Weber et al. | 362/352 |
| 4,467,405 | 8/1984 | Weber | 362/352 |
| 4,541,038 | 9/1985 | VanNoord | 362/352 |
| 4,656,568 | 4/1987 | Reed | 362/352 |

FOREIGN PATENT DOCUMENTS

| | | | |
|---|---|---|---|
| 924276 | 4/1973 | Canada | 362/352 |
| 563294 | 8/1944 | United Kingdom | 362/358 |

*Primary Examiner*—William A. Cuchlinski, Jr.
*Assistant Examiner*—D. M. Cox
*Attorney, Agent, or Firm*—Stoll, Wilkie, Previto & Hoffman

[57] ABSTRACT

An insert strip which is detachably insertable into a receiver strip so as to form a plate shelf to retain the side walls of the plate glass panels of a lampshade. A lower support which has a retainer ridge which conforms to the shape of the lower wall of the plate glass panel and retains the plate glass panel therein. The lower support also has a catch on either end thereof which fits into and is retained by catch holes on an injection plate. The injection plate also has an insert strip cavity and retainer walls which retain the insert strip and the receiver strip, respectively.

2 Claims, 8 Drawing Figures

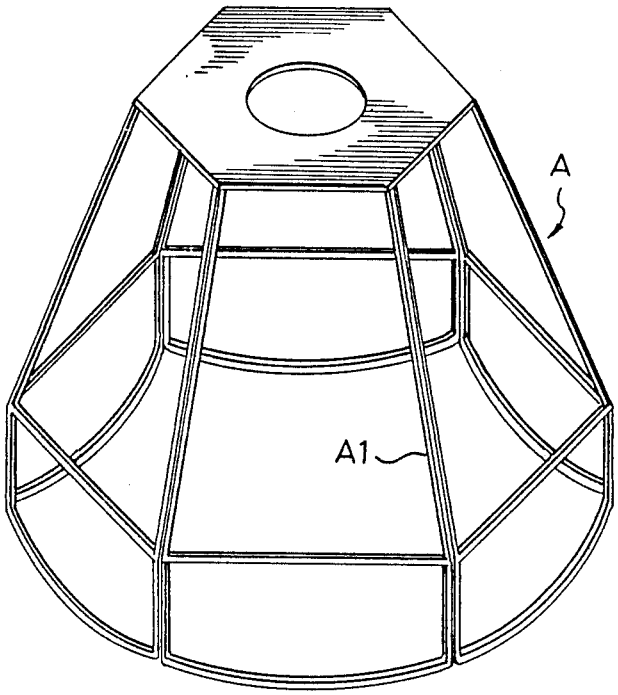
FIG. 5-A PRIOR ART
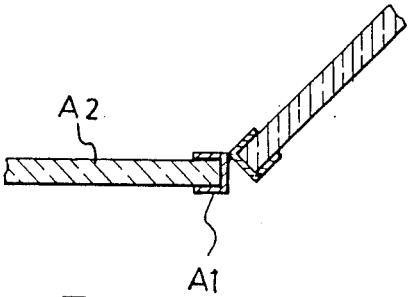
FIG. 5-B PRIOR ART

SUPPORT STRUCTURE FOR PLATE GLASS LAMP SHADES

BACKGROUND OF THE INVENTION

This invention relates to an improvement in lighting structures, especially plate glass lamps and the like. It will be understood that "plate glass" in this specification refers to plate glass, plastic sheets, or any other similar transluscent material which can be used in lamp shades as paneling. In the past, plate glass lamps, such as tiffany style lamps, were difficult to pack and/or move because of their irregular shape and very fragile material. To make matters worse, these lamps could not be disassembled or they could be disassembled but this process involved tedious and delicate screwing and unscrewing of the glass plates. A previous type of lampshade (B) can be seen in FIG. 6. This type of lampshade is similar to that disclosed in U.S. Pat. No. 1,123,792 by Person et al. The frame B1 of the lampshade has stationary flaps B2 which receive screws to hold a glass plate B3 thereto. However, the person assembling or disassembling the lampshade had to be especially careful not to screw the plate B3 down too tightly or it would crack. Also, since usually these flaps were made of thin metal and were therefore easily bent, so as to complicate assembly. Also, as is obvious from FIG. 6, the number of screws involved could make dissassembling and assembling such a light to be a cumbersome process.

A second type of prior art can be seen in FIGS. 5-A and 5-B. This type is called the "inlay" type (i.e. ref. #A). Of course, the inlay type of lampshade (A) can not be disassembled at all and is hence even more inconvenient to move or to repair than type B. An example of this type of lamp structure can be seen in U.S. Pat. No. 912,426 by Sibley.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide a lampshade structure which can be easily assembled and disassembled.

Another objective of this invention is to provide a lampshade which can be easily repaired or installed with a new set panel by the end user.

Further objectives and advantages of the present invention will become apparent as the following description proceeds, and the features of novelty which characterize the invention are pointed out with particularity in the claims annexed to and forming a part of this invention.

BRIEF DESCRIPTION OF THE DRAWINGS

FIG. 5-A is prior art of an "inlaid" style lampshade frame;

FIG. 5-B is cross-sectional view showing how the frame and the glass plates of a conventional lampshade of the "inlaid" style seen in FIG. 5-A;

DETAILED DESCRIPTION OF THE PREFERRED EMBODIMENT

Figure 1:
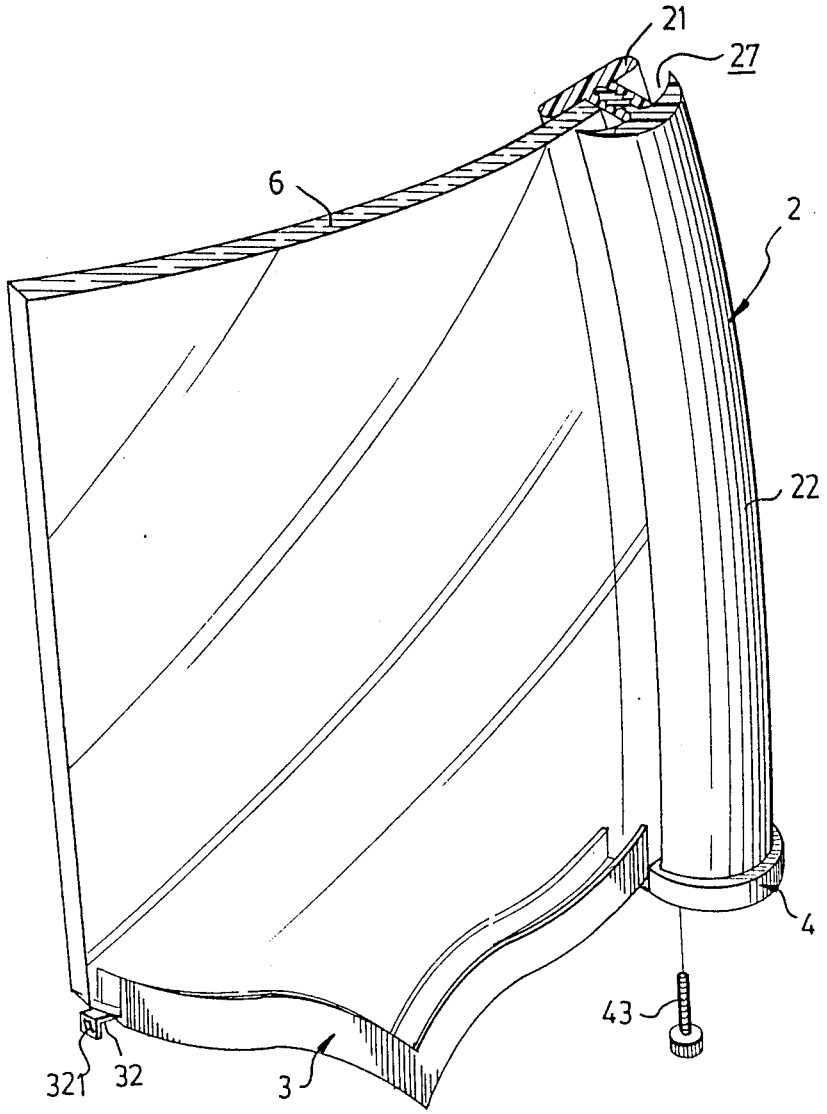
FIG. 1 is a partially cut away perspective view of an embodiment of the present invention, showing only one panel.
Figure 2:
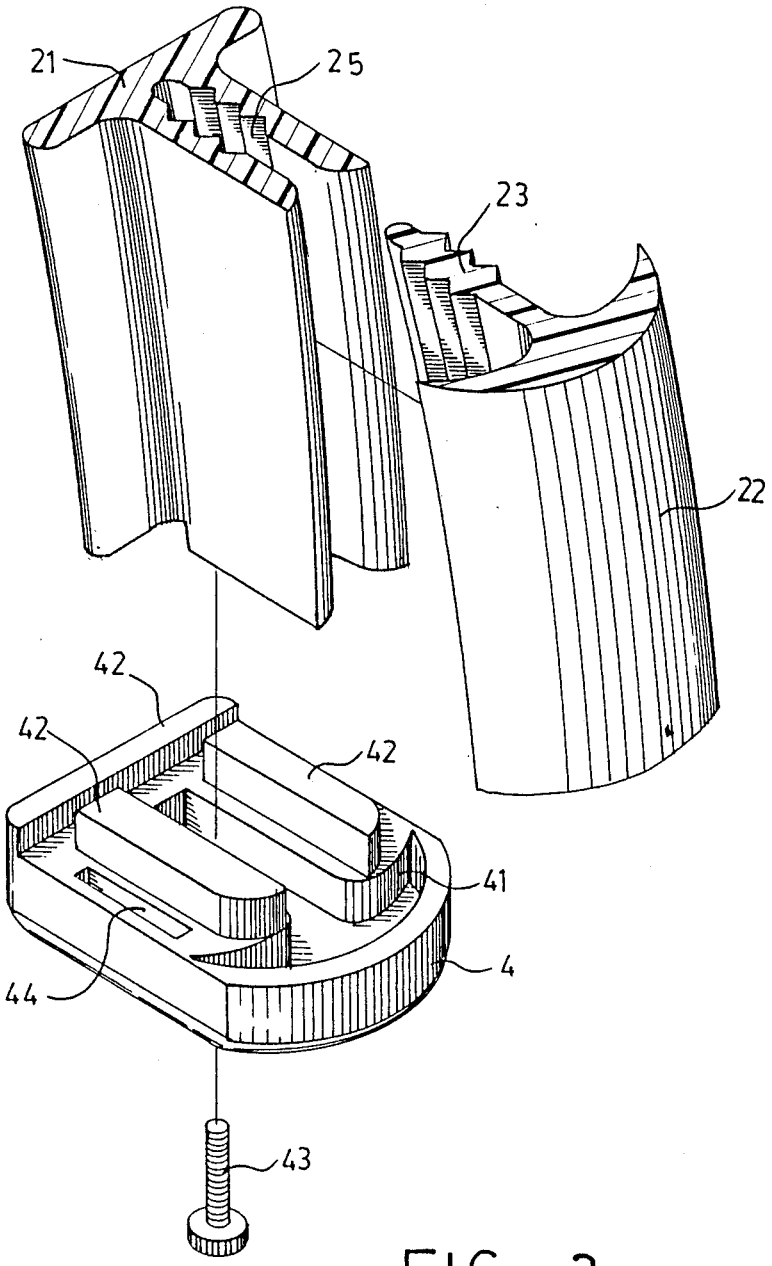
FIG. 2 is a cut away exploded view of the lower portion of an insert strip and the injection plate of an embodiment of the present invention.

Referring to FIG. 1, it can be seen that the present invention comprises a strip assembly 2, an injection plate 4, and a lower support 3. The strip assembly 2 further comprises a receiver strip 21 and an insert strip 22. Further referring to FIG. 2, the insert strip 22 is seen to have a ridged insert 23 which, when engaged, provides stable engagement with a ridged receptacle 25. When the ridged insert 23 and the ridged receptacle 25 are engaged, the two inside faces therebetween and the long back face of the ridged receptacle 25 form a plate shelf 27 into which plate glass 6 fits. The receiver strip 21 and the injection plate 4 are originally engaged by means of a screw 43. Then, the plate glass 6 is placed on the receiver strip 21.

As can be seen in FIG. 1, an injection plate 4 secures both the lower support 3 and the strip assembly 2 in place. The catches 32 which are on either end of the lower support 3 fit into catch holes 44 on either side of the injection plate 4 and the insert strip 22 fits into the insert strip cavity 41. The receiver strip 21 does not fit into a cavity but instead is retained by retainer walls 42.

Figure 3:
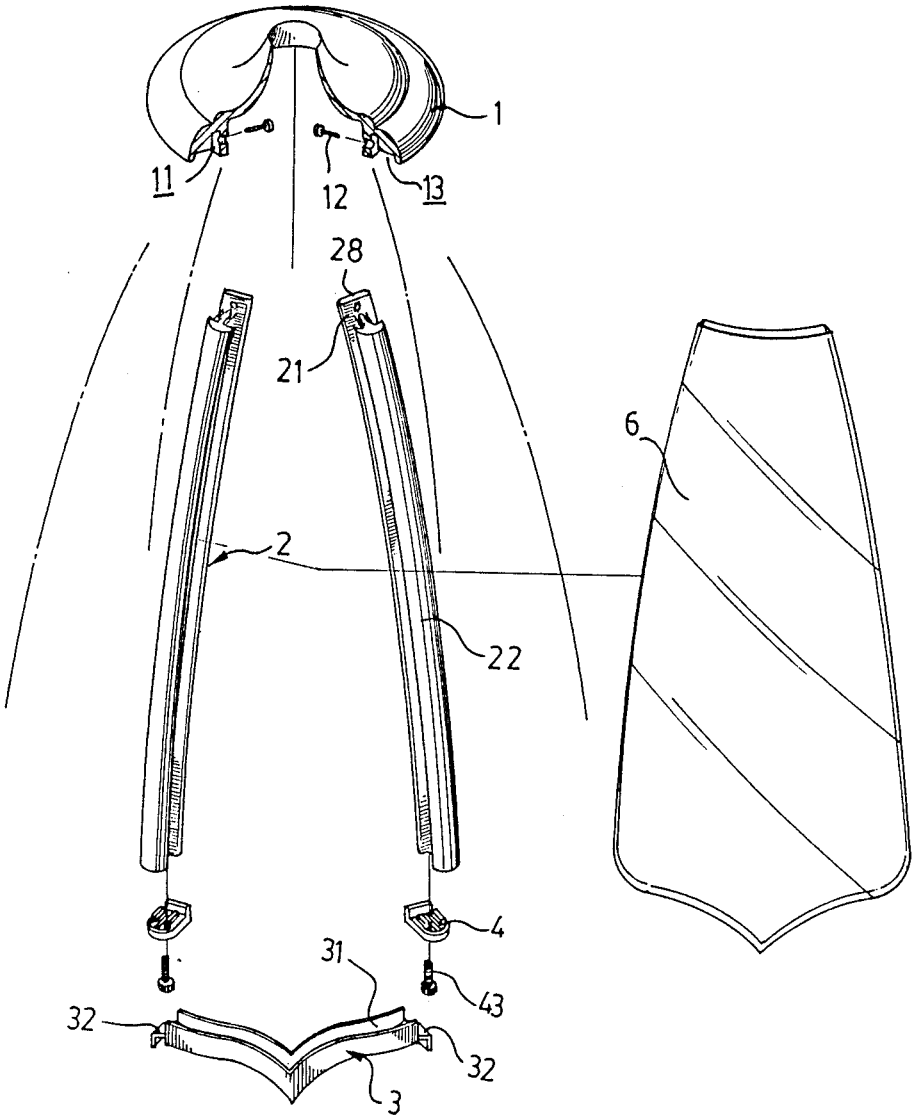
FIG. 3 is an exploded view of an entire glass panel in relation with the strip assembly, lamp cover, and lower support of an embodiment of the present invention.

FIG. 3 shows the various parts of an embodiment of the present invention in relation to each other in exploded form (except for the strip assembly). It can be understood that when assembling the present invention, each of the abutments 28 of the insert strip 22 must be placed in the abutment slots 11 and fixed to the lamp cover 1 by means of a lamp cover screw 12. Next, the catch 32 of the lower support is placed in the catch hole 44 of the injection plate 4 (see FIG. 1). The catch 32 has a flat spring 321 on the side thereof which helps to stabilize the catch 32 by engaging in a matching slot (not shown) in the catch hole 44. Next, a plate of glass 6 is placed on the receiver strip 21. After the plate glass 6 is in place, the insert strip 22 may be inserted into the receiver strip 25. The upper and lower ends of the insert strip 22 must be inserted first (so that it forms a concave outward shape) and then gradually pushed in more and more towards the middle, until the entire length of the insert strip 22 is "snapped" into place. As already mentioned, the injection plates 4 are fixed in place by screws 43. To disassemble for repair or replacement of a broken plate of glass, it is not necessary to unscrew the injection plate screws 43; instead, simply pull out the insert strip 22, starting from the middle thereof and proceeding to the ends thereof. Then, the plate glass 6 can be removed.

Figure 4:
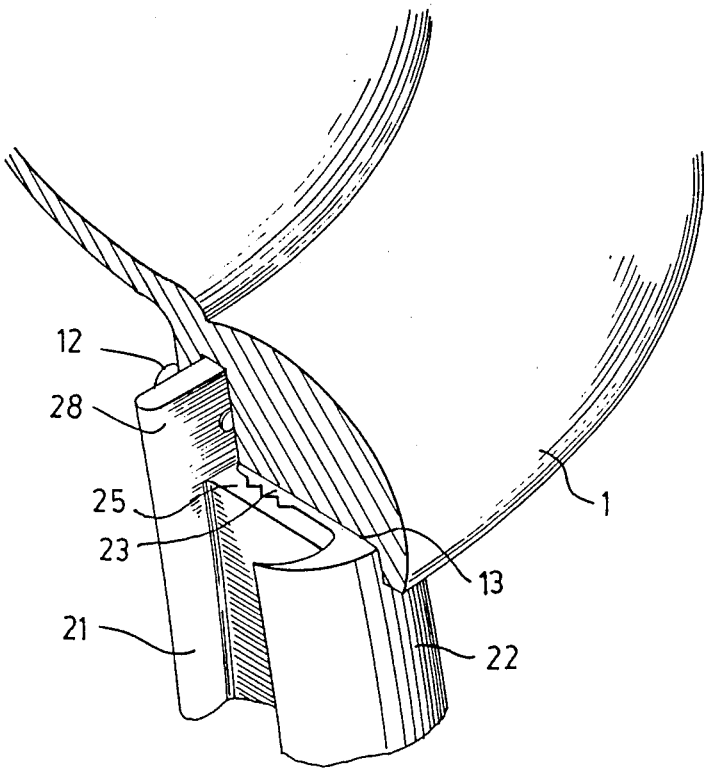
FIG. 4 is a partially cut away perspective view of an embodiment of the present invention showing how a lamp cover interfits with the insert strip.
Figure 6:
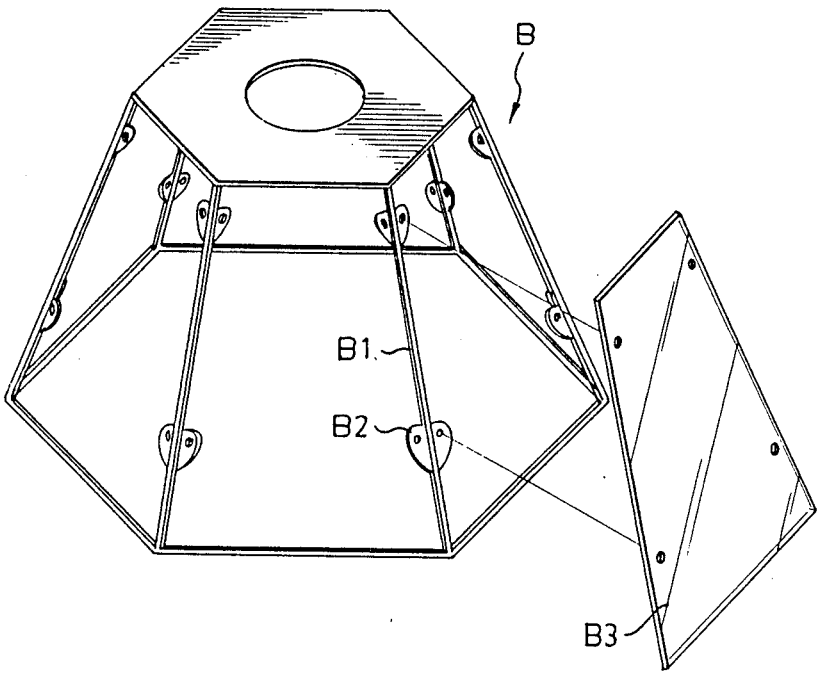
PRIOR ART FIG. 6.
FIG. 6 is prior art of a lampshade having stationary flaps for receiving screws therein.

FIG. 4 shows a close-up view of how the abutment 28 of the strip assembly 2 fits into a slot 14 on the lamp cover 1. The top end of the ridged receptacle 25 and the ridged insert 23 also fit squarely against the rim 13 of the lamp cover 1. Of course, the abutment 28 is fixed to the lamp cover by screw means 12.

Figure 7:
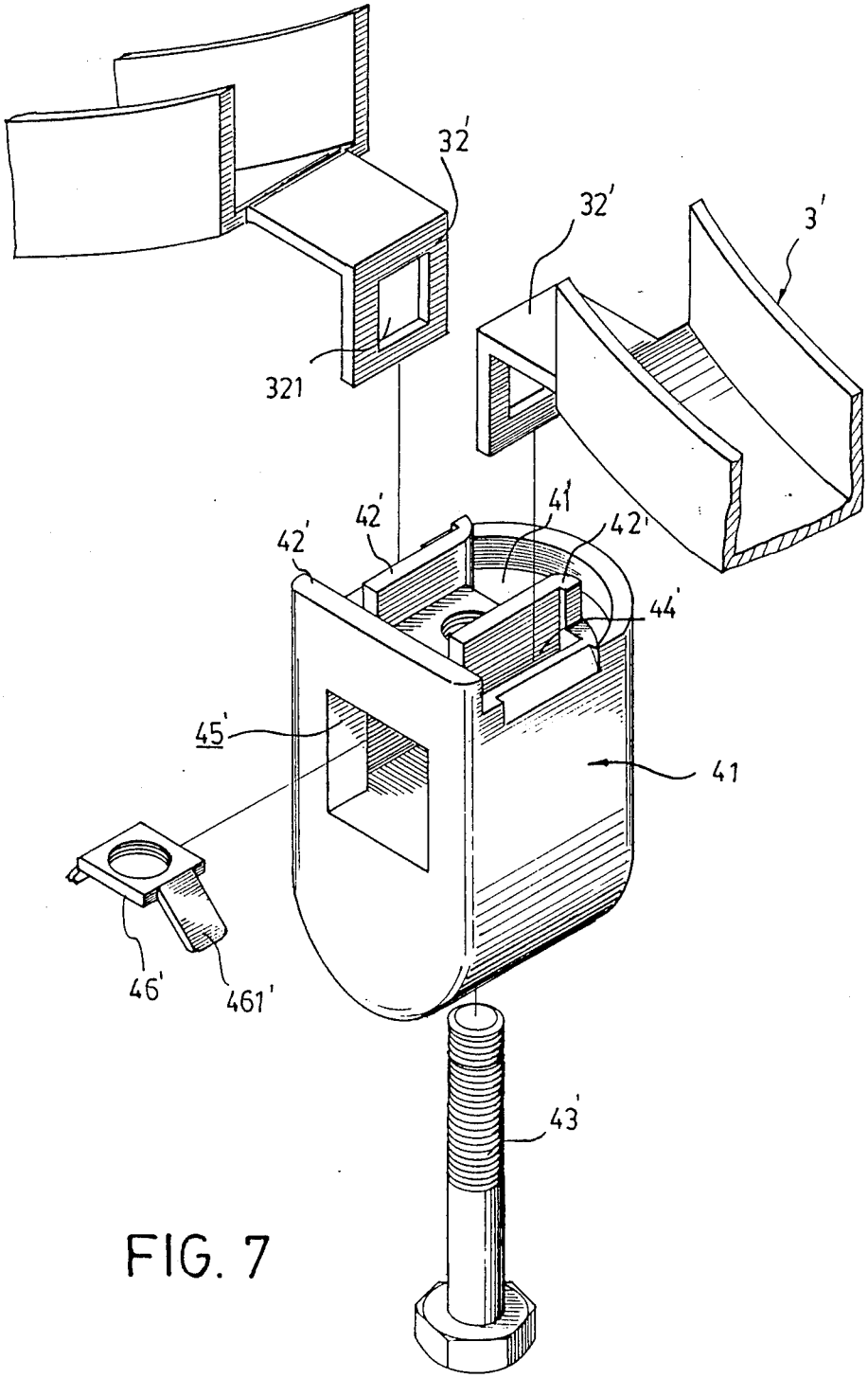
FIG. 7 is an exploded view of a second embodiment of the injection plate, also showing the correspondingly slightly modified catches of a lower support.

In FIG. 7, an alternate embodiment of the injection plate 4' can be seen. This embodiment has a press spring 46' which fits in the cavity 45'. When the mount 4' and the catch 3' is to be assembled together (this may at the production facility or at the end user's), the screw 43' is threaded through the mount 4' and the press spring 46' and finally through the screw hole in the top of the mount 4'. As the user continues to thread the screw 43', the press spring 46' is threaded downwards so that it begins to flatten out. As the press spring 46' begins to flatten out, the legs 461' extend through the holes 321' so that the catch 32' is securely fixed together with the mount 4'. In this condition, the legs 461' can not be removed unless the screw 43' is loosened so as to allow the press spring 46' to spring back to its original position.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

We claim:

1. A support structure for plate glass lamp shades comprising:

(A) a plurality of strip assemblies, each of said strip assembly further comprising a receiver strip with an abutment and an insert strip, said insert strip having a ridged insert which is securely engagable with a ridged receptacle projecting from said abutment on said receiver strip;

(B) a plurality of lower supports which correspond to the shape of the lower edge of a glass plate, said lower supports having catches on either end thereof, a plate glass retainer forming the top surface of said lower support;

(C) a plurality of injection plates which secure both said lower supports and said strip assemblies in place, each of said injection plates having a catch hole on either side thereof, each of said injection plates also having an insert strip cavity for receiving an insert strip; each injection plate being fixed to said insert strip by means of a screw; and (D) a lamp cover, said lamp cover having an abutment on said receiver strip slot to receive said abutment, said lamp cover also having a rim to receive the top end of said ridged receptacle and ridged insert.

2. A support structure for plate glass lamp shades, as set forth in claim 1, and being further characterized in that:

said catches each have a hole thereon; said insertion plate has a cavity which contains a threaded press spring therein, said press spring receives and is elastically flattenable by said screw means so that the legs on said press spring extend through said holes to secure the catch to said insertion plate.

* * * * *